United States Patent [19]

Hartzell

[11] Patent Number: 4,494,426

[45] Date of Patent: Jan. 22, 1985

[54] PUNCH WITH REMOVABLE BLADE

[76] Inventor: John C. Hartzell, 19249 Allen Rd., Trenton, Mich. 48183

[21] Appl. No.: 496,614

[22] Filed: May 20, 1983

[51] Int. Cl.[3] ..... B26F 1/14

[52] U.S. Cl. ..... 83/164; 83/165; 83/684; 83/698

[58] Field of Search ..... 83/164, 165, 684, 646, 83/647, 669, 698, 700, 677

[56] References Cited

U.S. PATENT DOCUMENTS

| | | | |
|---|---|---|---|
| 961,653 | 6/1910 | Setter | 83/165 X |
| 1,993,041 | 3/1935 | Singer | 83/165 X |
| 2,052,657 | 9/1936 | Raiche | 83/165 X |
| 2,087,186 | 7/1937 | Freeman | 83/684 X |
| 2,270,639 | 1/1942 | Parks | 83/677 X |
| 3,128,663 | 4/1964 | Dovey | 83/700 |
| 3,482,478 | 12/1969 | Einhorn | 83/346 X |

FOREIGN PATENT DOCUMENTS

| | | | |
|---|---|---|---|
| 259735 | 10/1926 | United Kingdom | 83/346 |

*Primary Examiner*—James M. Meister
*Attorney, Agent, or Firm*—Charles W. Chandler

[57] ABSTRACT

A punch for cutting an elongated slug from material has a removable hollow blade having first and second sides, one side shorter than the other. The blade is received in a body having upper and lower seats for receiving the first and second sides of the blade. An opening in the body allows for passage of the severed slug.

2 Claims, 6 Drawing Figures

PUNCH WITH REMOVABLE BLADE

BACKGROUND OF THE INVENTION

This invention is related to punches for cutting an opening in cardboard material, and more specifically toward a punch having a removable blade for cutting an elongated slot in cardboard or plastic material.

Display packaging of the type hung on an elongated wire support is punched with a slot for receiving the support to mount the packaging in an upright position. The slot is normally punched with a unitary punch comprising a body having an inlet opening and an outlet opening disposed at right angles to the inlet opening. A raised cutting edge around the inlet opening provides means for cutting a slug from a sheet of cardboard to form an opening. The slug passes through the body of the punch to the outlet opening.

One problem with such a punch is that when the cutting edge has become worn, the entire punch must be replaced. In addition, the punch is mounted in a die. There are no means for adjusting the height of the cutting edge with respect to the die. Such punches are relatively expensive to replace, particularly when they are employed in large numbers in conventional dies.

SUMMARY OF THE INVENTION

The broad purpose of the present invention is to provide a punch for cutting a slot in cardboard or plastic material in which the punch has a removable cutting blade which can be replaced when the blade becomes dull or broken.

Another object of the invention is to provide such a punch with means for quickly and readily removing the blade to replace it.

A still further object is to provide a self-cleaning punch having a replaceable blade for punching an opening in cardboard material.

Still another object is to provide means for adjusting the height of the punch with respect to the die.

Still further objects and advantages of the invention will become readily apparent to those skilled in the art to which the invention pertains upon reference to the following detailed description.

DESCRIPTION OF THE DRAWING

The drawing refer to the accompanying figures in which like reference characters refer to like parts throughout the several views, and in which.

DESCRIPTION OF THE PREFERRED EMBODIMENT

Figure 1:
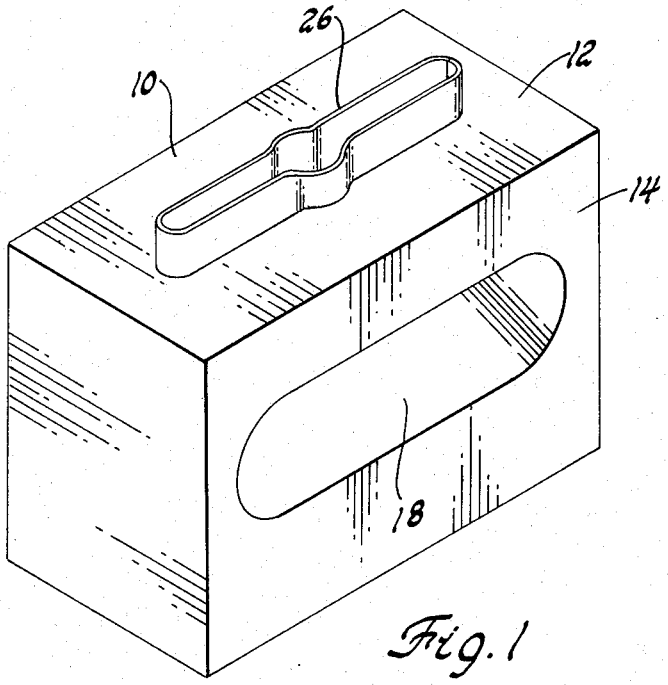
FIG. 1 is a perspective view of a punch illustrating the preferred embodiment of the invention.

Referring to the drawing, FIG. 1 illustrates a preferred self-cleaning punch having a metal body 10, having top surface 12 and side surface 14. The punch has inlet opening 16 in top surface 12, and outlet opening 18 in surface 14. Inlet opening 16 is connected to outlet opening 18.

The body has a slot forming a lower seat 20, and lip forming upper seat 22.

A cutting blade 24 is mounted in inlet opening 16. The cutting blade is formed of steel rule, a relatively thin carbon steel strip having its upper edge beveled to form cutting edge 26. Blade 24 is hollow with the configuration of the cutting edge conforming to the slug to be punched in the cardboard material. As best illustrated in FIGS. 1 and 3, the cutting blade has an elongated configuration with opposed enlargements in its mid-section corresponding to the standard slot in display packaging.

Figure 3:
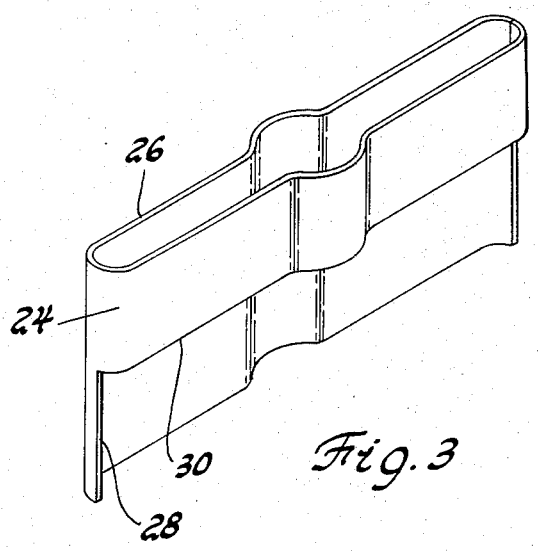
FIG. 3 is a perspective view of a preferred blade.

Referring to FIG. 3, one side of the blade has a cutout portion 28 which extends the full width of the blade and has a height permitting the lower edge 30 of the short side to rest on seat 22 as the bottom of the blade is disposed on seat 20.

Figure 5:
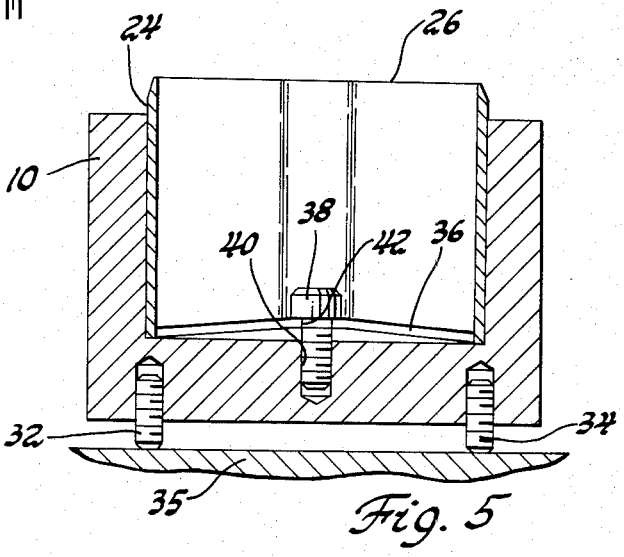
FIG. 5 is a view as seen along lines 5—5 of FIG. 4.

Referring to FIG. 5, a pair of set screws 32 and 34 are mounted in the bottom of the body and disposed to engage die 35 to adjust the height of cutting edge 26 above the die.

Figure 2:
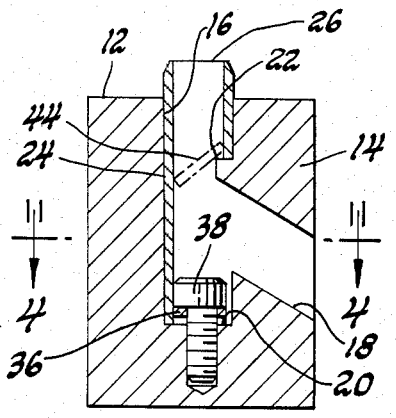
FIG. 2 is a sectional view through the punch of FIG. 1.
Figure 4:
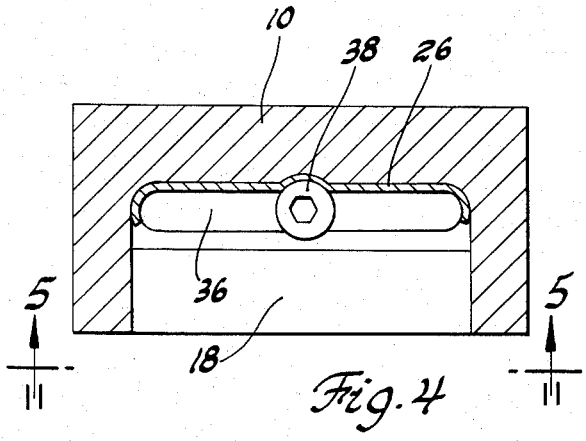
FIG. 4 is a view as seen along lines 4—4 of FIG. 2.

Referring to FIGS. 2, 4 and 5, an elongated fastening member 36 is mounted in the body adjacent the lower edge of the cutting blade.

A threaded fastener 38 is threadedly connected at 40 to the body and passes through opening 42 of the fastener member. The fastener member has a somewhat bowed configuration so that as fastener 38 is tightened into the body, the ends of fastener 36 spread to wedge the opposite ends of the blade between the fastener member and body 10. This arrangement permits the blade to be securely locked into position when it is employed in a punching operation, however, it permits the blade to be quickly removed when it is to be exchanged for a new blade.

Referring to FIG. 2, seat 22 has a thickness greater than the thickness of the cutting blade to form a partial obstruction to a slug 44 cut by the blade in such a manner that as the slug passes downwardly toward the outlet opening, it is pivoted in order to prevent the slugs from being compacted in the slot.

Figure 6:
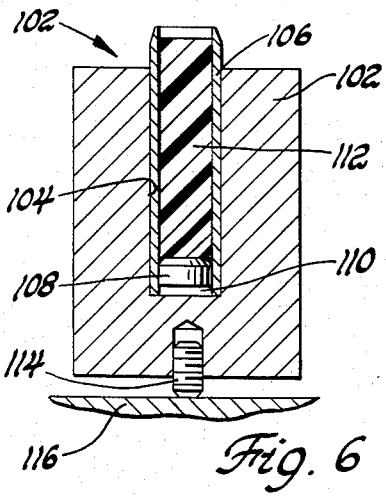
FIG. 6.

FIG. 6 illustrates a punch 100 having body 102 with blade opening 104. Blade 106 is seated in opening 104. Fastener 108 engages locking member 110 to wedge the blade in its cutting position. Locking member 110 has the configuration of member 36 illustrated in FIG. 5.

A rubber member 112 having a shape corresponding to the inside wall of the cutting blade is mounted in the bottom of the cutting blade to prevent slugs from compacting in the punch.

Adjustment means 114 threadably mounted in the bottom of the body provides means for adjusting the height of the blade above supporting die 116.

Thus it is to be understood that I have described an improved punch having a removable cutting blade. The height of the cutting edge of the blade can be readily adjusted with respect to the die.

Having described my invention, I claim:

1. A punch for cutting an elongated slug from a sheet of material, comprising:

a body having a first opening, and a second opening connected to the first opening for removal of the slug;

the body having a lower seat and an upper seat disposed between said openings, the upper seat being disposed adjacent the first opening;

a hollow blade received in the body, the blade having a pair of opposed sides including a first side, and a second side shorter than the first side, the blade being mounted on the lower seat such that the upper seat supports the short side of the blade whereby the blade is disposed to define a generally continuous cutting edge about said first opening for punching a slug in the sheet material, and the upper seat engages the slug as it passes through the blade toward the second opening; and means in the body for locking the blade in a cutting position.

2. A punch as defined in claim 1, in which the locking means includes an elongated fastening member disposed in the body between opposite sides of the blade, and a threaded fastener threadably connected to the body and engaged with the fastening member such that opposite ends thereof engage opposite sides of the blade to wedge same in the body opening.

* * * * *